US005720430A

United States Patent [19]

Rowland

[11] Patent Number: 5,720,430

[45] Date of Patent: Feb. 24, 1998

[54] DISPENSING CARTON WITH INTEGRAL POUR SPOUT

[75] Inventor: Angela L. Rowland, Trappe, Pa.

[73] Assignee: Jefferson Smurfit Corporation, Clayton, Mo.

[21] Appl. No.: 646,980

[22] Filed: May 8, 1996

[51] Int. Cl.[6] ..... B65D 5/74

[52] U.S. Cl. ..... 229/215; 229/129.42

[58] Field of Search ..... 222/535; 229/215, 229/210, 207, 219, 221, 160.2, 125.04, 125.08, 125.42

[56] References Cited

U.S. PATENT DOCUMENTS

| | | | |
|---|---|---|---|
| 1,847,028 | 2/1932 | Townsend | 229/125.04 X |
| 3,202,336 | 8/1965 | Bord | 229/125.42 |
| 3,344,972 | 10/1967 | Robinson et al. | 229/215 |
| 3,570,743 | 3/1971 | Mohler | 229/215 |
| 4,194,677 | 3/1980 | Wysocki | 22/215 |
| 5,238,181 | 8/1993 | Mahler | 229/221 X |
| 5,316,212 | 5/1994 | Eriksson et al. | 229/125.42 X |
| 5,372,301 | 12/1994 | Besson | 229/125.04 X |
| 5,429,297 | 7/1995 | Walsh | 229/215 |
| 5,445,316 | 8/1995 | Roccaforte | 229/215 |
| 5,531,376 | 7/1996 | Brink et al. | 229/215 |
| 5,660,324 | 8/1997 | Rowland | 229/215 |

FOREIGN PATENT DOCUMENTS

| | | | |
|---|---|---|---|
| 528349 | 10/1940 | United Kingdom | 229/125.42 |

*Primary Examiner*—Kevin P. Shaver
*Attorney, Agent, or Firm*—Richard W. Carpenter

[57] ABSTRACT

A one piece, paperboard, dispensing carton having a dispensing opening in a side wall panel thereof that is covered by a cover panel, foldably and detachably joined to the side wall panel, and also having a pour spout, secured to the cover panel and joined to an upper edge of the carton side wall panel by a connecting member. The pour spout includes hooks for preventing it from being pulled too far out of the carton, recesses for maintaining the pour spout in an open position, and tabs for preventing the pour spout from being pushed too far into the carton.

20 Claims, 2 Drawing Sheets

DISPENSING CARTON WITH INTEGRAL POUR SPOUT

BACKGROUND OF THE INVENTION

1. Field of the Invention

This invention relates to paperboard dispensing cartons of the type generally used for the packaging of granular products, and more particularly to cartons having integral pour spouts.

2. Description of the Background Art

A background art search directed to the subject matter of this invention conducted in the United States Patent and Trademark Office disclosed the following United States Letters Patent:

| | | | |
|---|---|---|---|
| 1,907,939 | 2,332,205 | 2,444,104 | 2,610,770 |
| 2,701,679 | 3,184,137 | 3,344,972 | 3,362,612 |
| 3,484,034 | 3,570,743 | 4,111,351 | 4,192,440 |
| 4,194,677 | 4,569,443 | 4,953,781 | 5,014,888 |
| 5,238,181 | 5,316,212 | 5,372,301 | CA 586,884 |
| NO 92,486 | | | |

None of the patents uncovered in the search discloses a one piece, paperboard, dispensing carton having a dispensing opening in a side wall panel thereof that is covered by a cover panel, foldably and detachably joined to the side wall panel, and also having a pour spout, secured to the cover panel and joined to an upper edge of the carton side wall panel by a connecting member, wherein the pour spout includes means for preventing it from being pulled too far out of the carton, means for maintaining the pour spout in an open position, and means for preventing the pour spout from being pushed too far into the carton.

SUMMARY OF THE INVENTION

It is a primary object of the invention to provide a unique paperboard dispensing carton including an integral pour spout that is joined to a carton side wall panel by a unique, three piece, connecting member which covers a portion of a dispensing opening.

Another object of the invention is the provision of a dispensing carton wherein the pour spout includes means for preventing the spout from being pulled too far out of the carton, means for maintaining the pour spout in an open position, and means for preventing the spout from being pushed too far into the carton.

A more specific object of the invention is to provide a carton of the type described wherein the carton pour spout includes hooks at the ends of the pour spout side panels, recesses adjacent the hooks, and tabs projecting laterally from opposite side of the pour spout central panel.

These and other objects of the invention will be apparent from an examination of the following description and drawings.

DESCRIPTION OF THE PREFERRED EMBODIMENT

Figure 1:
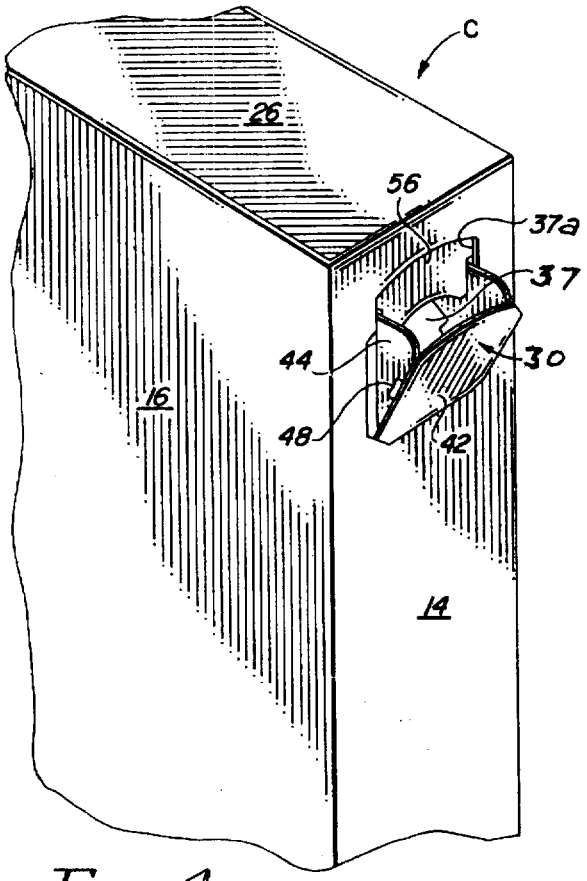
FIG. 1 is an isometric view of a portion of a dispensing carton with a pour spout arrangement embodying the invention.
Figure 2:
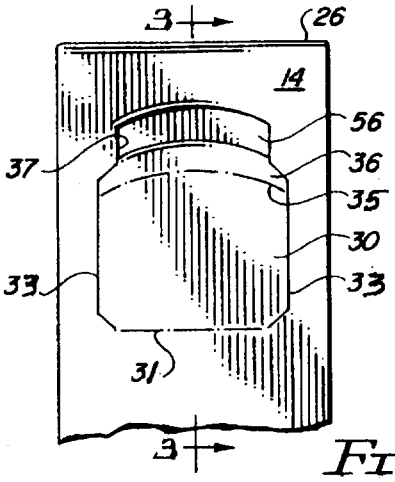
FIG. 2 is an end elevational view of a portion of the structure illustrated in FIG. 1.
Figure 3:
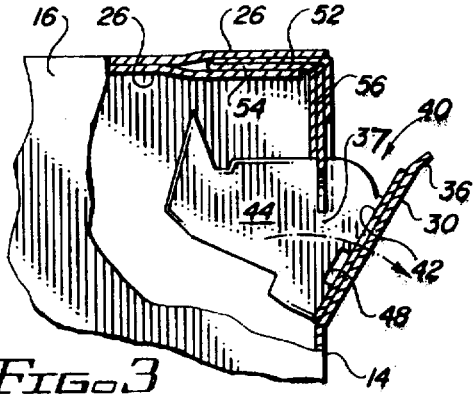
FIG. 3 is a sectional view taken on line 3—3 of FIG. 2
Figure 4:
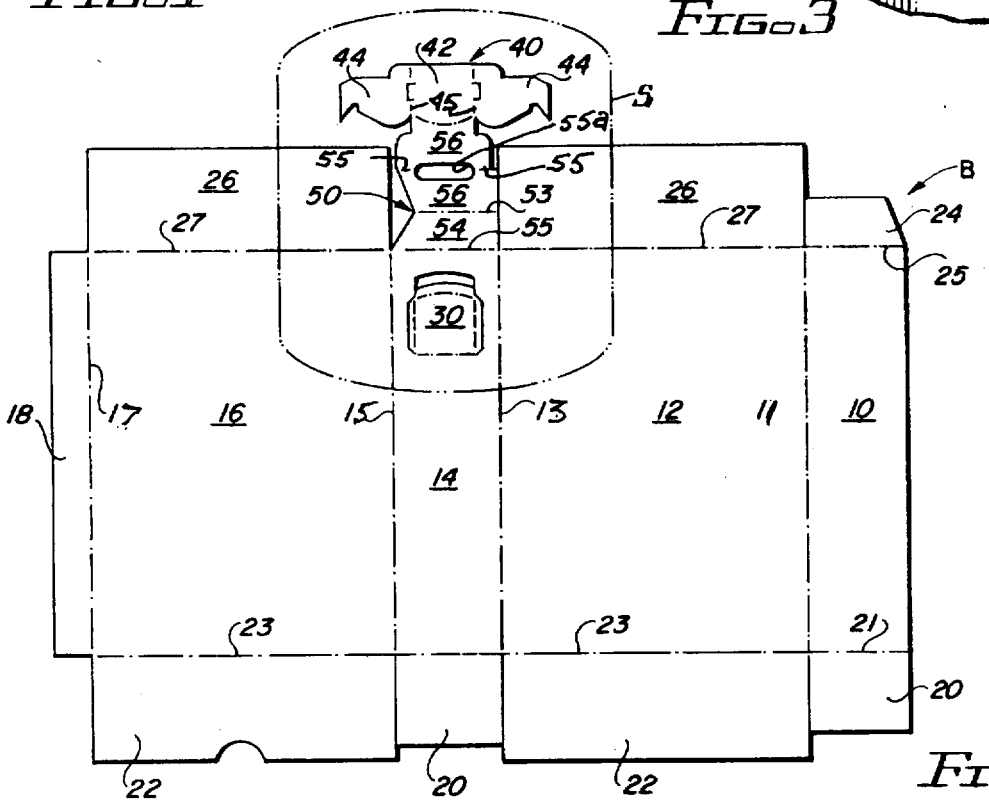
FIG. 4 is a top plan view of a blank of sheet material from which the carton illustrated in the other views may be formed.
Figure 5:
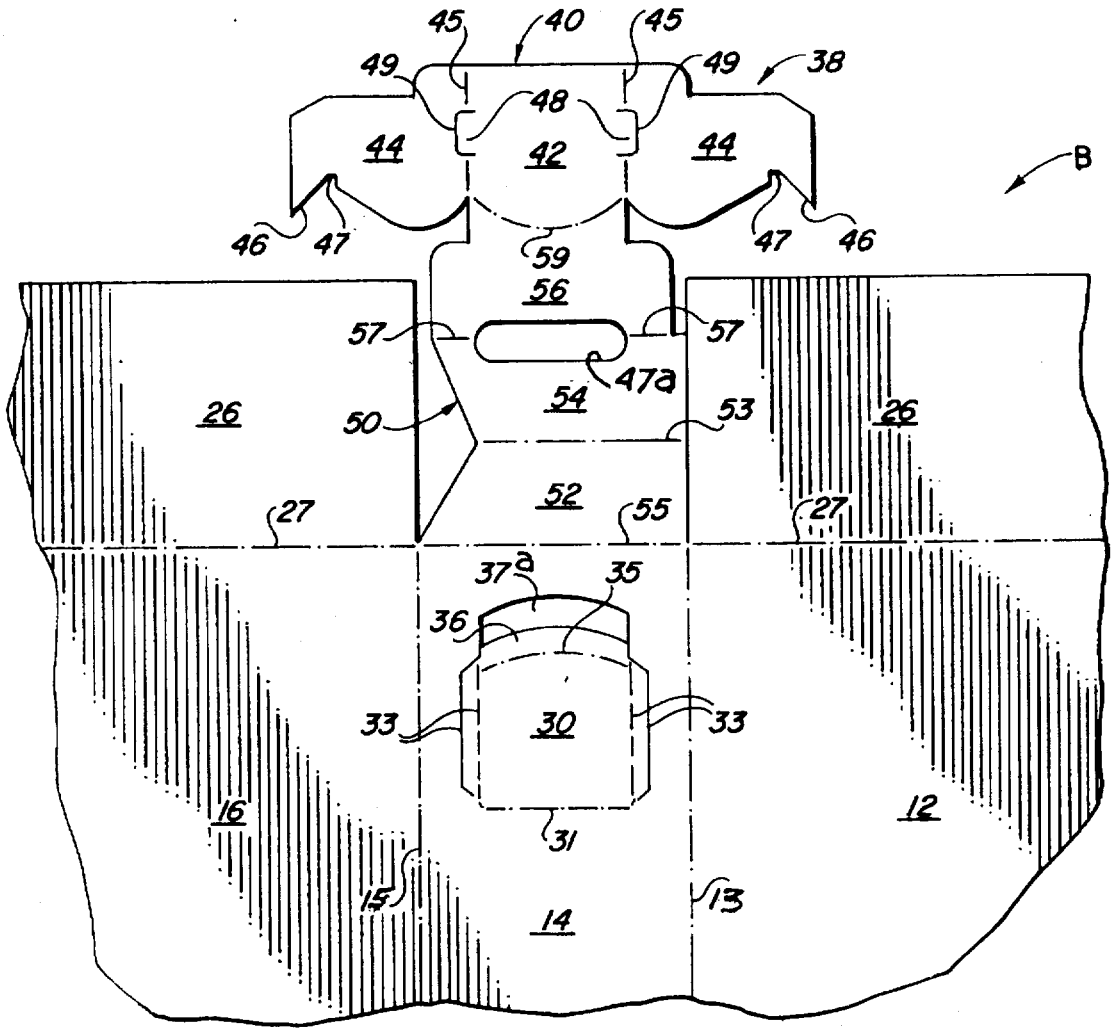
FIG. 5 is an enlarged view of a portion of the structure It will be understood that, for purposes of clarity, certain elements may have been omitted from certain views where they are believed to be illustrated to better advantage in other views.

Referring now to the drawings for a better understanding of the invention, it will be seen that the dispensing carton embodying features of the invention, and indicated generally at C in FIGS. 1–3, may be formed from the unitary blank B of foldable sheet material, such as paperboard, illustrated in FIGS. 4 and 5.

As best seen in FIG. 4, carton C has a main or body portion that includes a first minor side wall panel 10, a first major side wall panel 12, a second minor side wall panel 14, a second major side wall panel 16, and a glue flap 18 that are foldably joined to each other, along parallel fold lines 11, 13, 15, and 17, to form a tubular structure open at the upper and lower ends.

The lower end of the carton may be closed by a pair of minor lower closure flaps 20 and a pair of major lower closure flaps 22, foldably joined to the lower ends of the minor and major side wall panels along fold lines 21 and 23, respectively, and secured to each other in overlapped relation.

The upper end of the carton may be closed by a minor upper closure flap 24, foldably joined, along fold line 25, to an upper end of minor side wall panel and a pair of major upper closure flaps 26, foldably joined, along fold lines 27, to the upper ends of major side wall panels 12 and 16, respectively, and secured to each other in overlapped relation.

Second minor side wall panel is provided with a dispensing opening 37, located a relatively short distance below the upper end of the side wall panel. The major portion of opening 37 is initially covered by an integral cover panel 30 defined by a lower horizontal fold line 31, hinging the cover panel to the side wall panel, by a pair of vertical weakened lines of tear 33 extending upwardly from opposite ends of fold line 31, and by a free upper edge that is spaced from the upper edge of opening 37.

Thus, panel 30 covers the major portion of opening 37, the remaining portion **37*a*** being covered by a section of pour spout connecting member, as hereinafter described.

In order to prevent sifting of material from the carton, the weakened lines of tear 33 are preferably each formed by a pair of laterally spaced partial cuts made from both the inside and outside of the carton side wall.

Spaced a relatively short distance below the upper edge of panel 30 is a fold line 35, which defines with the upper edge of panel 30 a relatively narrow strip of material that is adapted to be deflected outwardly to help one grasp the cover panel 30 and attached pour spout central panel 42 and pull the spout out of the carton with the end of a finger.

As best seen in FIGS. 1, 3, and 5, the pour spout structure 38 includes a pour spout 40 and a connecting member 50, which joins the pour spout to the carton second minor side panel 14, as hereinafter described, Again referring to FIG. 5, it will be seen that the pour spout, indicated generally at 40, includes a main or central panel 42 which is flanked by a pair of wings or side panels 44, foldably joined along fold lines 45 to opposite side edges thereof.

At their outer ends, side panels 44 are provided with upwardly projecting hook portions 46 that are adapted to engage the carton side wall panel and connecting member third section to prevent the pour spout from being pulled too far out of the carton.

Immediately inwardly adjacent hook portions 44, the side panel upper edges have recesses 47 that are adapted to engage the carton side wall panel and connecting member third section to temporarily maintain the pour spout in an open position.

In order to prevent the pour spout 40 from being pushed into the carton, panel 42 is provided with a pair of ears 48, defined by cut lines 49, that extend laterally outward from opposite sides of the main panel for engagement with the carton side wall panel.

Connecting member 50 is a three section unit that includes a first section 52, having an outer edge foldably joined on fold line 53 to the upper edge of side wall panel 14; a second section 54, having an inner edge foldably joined on fold line 55 to an inner edge of first section 52; and a third section 56, having an upper edge foldably joined on fold line 57 to an outer edge of second section 54. Opening 55*a* serves to relieve stress at fold line 55.

First and second sections 52 and 54 are folded to lie in face-to-face relation between outer major upper closure flaps 26. Third section is folded downwardly from second section to lie against and be adhesively secured to the inside surface of side wall panel 14.

Third section 56 extends downwardly beyond the upper edge of dispensing opening 37 to cover the upper portion 37*a* of opening 37.

Third section 56 has a lower edge detachably joined to the upper edge of pour spout central panel on a line of weakness 59.

Preferably line of weakness 59, the upper edge of opening 37, the upper edge of cover panel 30, the upper edge of pour spout central panel 42, and fold line 35 are all arcuate and parallel.

As previously mentioned, when the carton is formed and filled, the upper and lower closure flaps are folded over into overlapped condition and secured to each other, with the pour spout connecting member first and second sections 52 and 54 folded together and sandwiched between the major upper closure flaps 26.

The connecting member third section, which extends downwardly from the outer edge of the second section, is adhesively secured to the inner surface of second minor side wall panel 14 at a location between the upper edge of dispensing opening 37 and the upper edge of panel 14. At the same time the pour spout central panel is adhesively secured to the inner surface of cover panel 30.

It should be noted that the lower portion of the connecting member third section 56 covers the upper portion 37*a* of the dispensing opening 37 that lies above the cover panel 30.

In order to dispense material from the carton, a finger may be inserted just above the cover panel 30, and the cover panel and attached pour spout central panel 42 pulled out of the carton to form a pour spout 40. Deflection of cover panel upper marginal portion 36 facilitates opening the pour spout.

Hooks 44 prevent spout 40, from being pulled too far out of the carton; recesses 47 help hold the pour spout in open position; and ears 48 prevent the spout from being pushed into the carton.

What is claimed is:

1. A blank of foldable sheet material, for use in forming a dispensing carton with integral pour spout, said blank being cut and scored to provide:

(a) a first minor side wall panel, a first major side wall panel, a second minor side wall panel, and a second major side wall panel foldably joined to each other along parallel fold lines;

(b) minor and major lower closure flaps foldably joined to corresponding end edges of said minor and major side wall panels, respectively;

(c) one of said minor side wall panels having formed therein a dispensing opening, a major portion of which is covered by a cover panel that is formed from material of said one side wall panel, that has a lower edge foldably joined to said one minor side wall panel along a fold line, that has opposed side edges detachably joined to said one minor side wall panel by a pair of weakened lines of tear extending from opposite ends of said fold line, and that has a free edge spaced from said fold line;

(d) a pair of major upper closure flaps foldably joined to opposite end edges of said major side wall panels and a minor upper closure flap foldably joined to an opposite end edge of the other of said minor side wall panels;

(e) a pour spout including a central panel and a pair of side panels foldably joined to opposed sides if said central panel and having hooks at outer ends thereof;

(f) a connecting member arranged and disposed to join said pour spout to said carton one side wall panel, and including:

(i) a first section having an inner edge foldably joined to an adjacent opposite end edge of said one minor side wall panel;

(ii) a second section having an inner edge foldably joined to an outer edge of said first section;

(iii) a third section having an inner edge foldably joined to an outer edge of said second section and having an outer edge detachably joined to an inner edge of said pour spout central panel.

2. A carton blank according to claim 1, wherein said pour spout side panels have formed therein, adjacent said hooks, recesses adapted for engagement with related edges of said connecting member third section for temporarily maintaining said pour spout in an open position after it has been pulled out of said carton.

3. A carton blank according to claim 1, wherein said pour spout central panel includes a pair of tabs projecting outwardly from side edges thereof for engagement with said one minor side wall panel to prevent said pour spout from being accidentally pushed too far into said carton.

4. A carton blank according to claim 1, wherein said connecting member first and second sections are of substantially the same size and shape, and wherein said third section is foldably joined to said second section along a fold line that is arranged and disposed to be aligned with an adjacent upper end edge of said carton one minor side wall panel when a is erected.

5. A carton blank according to claim 1, wherein said connecting member third section is generally T-shaped with one portion thereof having a width equal to that of said one minor side wall panel and with another portion having a width equal to that of said pour spout central panel.

6. A carton blank according to claim 1, wherein said pour spout central panel includes a laterally extending fold line defining, with a free edge of said central panel, a relatively narrow strip adapted to facilitate grasping of said pour spout and pulling it out of said carton when said carton is erected.

7. A dispensing carton with an integral pour spout, said carton being formed from a unitary blank of foldable sheet material, and comprising:

(a) pairs of opposed major and minor side wall panels foldably joined to each other to form a tubular structure open at upper and lower ends thereof;

(b) major and minor lower closure flaps foldably joined to lower end edges of said major and minor side wall panels, respectively, and secured to each other in overlapped relation to close a lower end of said carton;

(c) one of said minor side wall panels having formed in an upper area thereof a dispensing opening, a major portion of which is covered by a cover panel that is formed from material of said one side wall panel, that has a lower edge foldably joined to said one minor side wall panel along a fold line, and that has opposed side edges detachably joined to said one minor side wall panel by a pair of weakened lines of tear extending upwardly from opposite ends of said fold line;

(d) a pair of major upper closure flaps foldably joined to upper end edges of said major side wall panels and a minor upper closure flap foldably joined to an upper edge of the other of said minor side wall panels, said upper closure flaps being secured to each other in overlapped relation to close an upper end of said carton;

(e) a pour spout including a central panel and a pair of side panels foldably joined to opposed sides of said central panel and having hooks at outer ends thereof;

(f) a pour spout connecting member joining said pour spout to said carton one side wall panel, and including:

(i) a first section having an outer edge foldably joined to an upper edge of said one minor side wall panel and extending inwardly from said one minor side wall panel above said dispensing opening;

(ii) a second section having an inner edge foldably joined to and inner edge of said first section and lying under said first section in face-to-face relation therewith;

(iii) a third section having an upper edge foldably joined to an outer edge of said second section, being adhesively secured to an inner face of said one minor side wall panel, and having a lower edge detachably joined to an upper edge of said pour spout central panel;

(g) said pour spout central panel being adhesively secured to an inner surface of said dispensing opening cover panel whereby when said cover panel is partially detached from said one minor side wall panel, at said weakened lines of tear, and pulled outwardly therefrom, said pour spout central panel will be detached from said connecting member third section and pulled outwardly therewith until said pour spout side panel hooks engage said connecting member third section to prevent said pour spout from being pulled completely out of said carton.

8. A carton according to claim 7, wherein said cover panel has a free edge spaced downwardly from an upper edge of said dispensing opening.

9. A carton according to claim 7, wherein said connecting member third section covers a remaining portion of said dispensing opening.

10. A carton according to claim 7, wherein said connecting member is partially secured under end portions of said major upper closure flaps.

11. A carton according to claim 7, wherein said pour spout side panels have formed therein, adjacent said hooks, recesses adapted for engagement with related edges of said connecting member third section for temporarily maintaining said pour spout in an open position after it has been pulled out of said carton.

12. A carton according to claim 7, wherein said pour spout central panel includes a pair of tabs projecting outwardly from side edges thereof for engagement with said one minor side wall panel to prevent said pour spout from being accidentally pushed too far into said carton.

13. A carton according to claim 7, wherein said connecting member first and second sections are of substantially the same size and shape, and wherein said third section is foldably joined to said second section along a fold line that is aligned with an adjacent upper end edge of said one minor side wall panel.

14. A carton according to claim 7, wherein said connecting member third section is generally T-shaped with one portion thereof having a width equal to that of said one minor side wall panel and with another portion having a width equal to that of said pour spout central panel.

15. A carton according to claim 7, wherein said pour spout central panel includes a laterally extending fold line defining, with an upper edge of said central panel, a relatively narrow strip adapted to facilitate grasping of said pour spout and pulling it out of said carton.

16. A dispensing carton with an integral pour spout, said carton being formed from a unitary blank of foldable sheet material, and comprising:

(a) pairs of opposed major and minor side wall panels foldably joined to each other to form a tubular structure open at upper and lower ends thereof;

(b) major and minor lower closure flaps foldably joined to lower end edges of said major and minor side wall panels, respectively, and secured to each other in overlapped relation to close a lower end of said carton;

(c) one of said minor side wall panels having formed in an upper area thereof a dispensing opening, a major portion of which is covered by a cover panel that is formed from material of said one side wall panel, that has a lower edge foldably joined to said one minor side wall panel along a fold line, that has opposed side edges detachably joined to said one minor side wall panel by a pair of weakened lines of tear extending upwardly from opposite ends of said fold line, and that has a free upper edge spaced downwardly from an upper edge of said dispensing opening;

(d) a pair of major upper closure flaps foldably joined to upper end edges of said major side wall panels and a minor upper closure flap foldably joined to an upper edge of the other of said minor side wall panels, said upper closure flaps being secured to each other in overlapped relation to close an upper end of said carton;

(e) a pour spout including a central panel and a pair of side panels foldably joined to opposed sides of said central panel and having hooks at outer ends thereof;

(f) a pour spout connecting member partially secured under end portions of said major upper closure flaps and including:

(i) a first section having an outer edge foldably joined to an upper edge of said one minor side wall panel and extending inwardly from said one minor side wall panel above said dispensing opening;

(ii) a second section having an inner edge foldably joined to and inner edge of said first section and lying under said first section in face-to-face relation therewith;

(iii) a third section having an upper edge foldably joined to an outer edge of said second section, being adhesively secured to an inner face of said one minor side wall panel to cover a remaining portion of said dispensing opening, and having a lower edge detachably joined to an upper edge of said pour spout central panel;

(g) said pour spout central panel being adhesively secured to an inner surface of said dispensing opening cover panel whereby when said cover panel is partially detached from said one minor side wall panel, at said weakened lines of tear, and pulled outwardly therefrom, said pour spout central panel will be detached from said connecting member third section and pulled outwardly therewith until said pour spout side panel hooks engage said connecting member third section to prevent said pour spout from being pulled completely out of said carton.

17. A carton according to claim 16, wherein said pour spout side panels have formed therein, adjacent said hooks, recesses adapted for engagement with related edges of said connecting member third section for temporarily maintaining said pour spout in an open position after it has been pulled out of said carton.

18. A carton according to claim 16, wherein said pour spout central panel includes a pair of tabs projecting outwardly from side edges thereof for engagement with said one minor side wall panel to prevent said pour spout from being accidentally pushed too far into said carton.

19. A carton according to claim 16, wherein said connecting member first and second sections are of substantially the same size and shape, and wherein said third section is foldably joined to said second section along a fold line that is aligned with an adjacent upper end edge of said one minor side wall panel.

20. A carton according to claim 16, wherein said connecting member third section is generally T-shaped with one portion thereof having a width equal to that of said one minor side wall panel and with another portion having a width equal to that of said pour spout central panel.

* * * * *